US005226286A

United States Patent [19]

Mo

[11] Patent Number: 5,226,286

[45] Date of Patent: Jul. 13, 1993

[54] REFRIGERATOR

[75] Inventor: Jin-yong Mo, Seoul, Rep. of Korea

[73] Assignee: SamSung Electronics Co., Ltd., Suwon, Rep. of Korea

[21] Appl. No.: 865,870

[22] Filed: Apr. 9, 1992

[30] Foreign Application Priority Data

Jul. 16, 1991 [KR] Rep. of Korea ..... 91-12143

[51] Int. Cl.[5] ..... F25D 21/14

[52] U.S. Cl. ..... 62/285; 62/291

[58] Field of Search ..... 62/272, 285, 288, 291, 62/279, 80, 81

[56] References Cited

U.S. PATENT DOCUMENTS

| | | | |
|---|---|---|---|
| 229,374 | 6/1880 | Bruns | 62/308 |
| 1,888,043 | 11/1932 | McCord et al. | 62/288 |
| 2,085,346 | 6/1937 | Vretman | 62/89 |
| 2,240,882 | 5/1941 | Brain | 62/89 |
| 2,539,148 | 1/1951 | Malir | 261/121 |
| 2,560,057 | 7/1951 | Williams | 62/103 |
| 2,626,509 | 1/1953 | Morrison | 62/103 |
| 3,174,301 | 3/1965 | Thornton et al. | 62/291 |
| 3,276,698 | 10/1966 | Wood | 239/452 |
| 3,451,226 | 6/1969 | Shriver | 62/285 |
| 3,590,594 | 7/1971 | Arend | 62/187 |
| 4,009,594 | 3/1977 | Swanson | 62/174 |
| 4,075,866 | 2/1978 | Williomitis | 62/274 |
| 5,046,330 | 9/1991 | Kim | 62/289 |

*Primary Examiner*—Albert J. Makay
*Assistant Examiner*—William C. Doerrler
*Attorney, Agent, or Firm*—Robert E. Bushnell

[57] ABSTRACT

A refrigerator comprises a lot of hollowed projections provided on the bottom of a reservoir and an auxiliary condenser secured to the top of the hollowed projections by supporting pieces in which one end is fixed in contact with the outer surface of the auxiliary condenser and the other end is fixed along one face of the hollowed projections so as to always be in contact with water, thereby improving the cooling efficiency of the auxiliary condenser and the evaporation efficiency of the water by directly transferring heat radiated from the auxiliary condenser to the water through supporting pieces.

20 Claims, 3 Drawing Sheets

REFRIGERATOR

BACKGROUND OF THE INVENTION

The present invention relates to a refrigerator, and more particularly to a refrigerator which improves the evaporation efficiency of water produced during defrosting, and the cooling efficiency of an auxiliary condenser.

Generally, when coolant absorbs heat via an evaporator for a refrigerator, moisture contained in the surrounding air freezes around the evaporator to form frost which covers the surface thereof. Since such frost decreases cooling efficiency, the frost is removed by a defroster. Water produced from the removal of the frost is collected in a reservoir placed on the bottom of a refrigerator. The collected water is removed by detaching the reservoir from the refrigerator or evaporating the water using heat from an auxiliary condenser.

FIG.1 schematically shows an exploded perspective view of a conventional refrigerator which comprises a reservoir 10 detachably provided on the bottom of a refrigerator body 14 for collecting water, an auxiliary condenser 11 located on the bottom of reservoir 10 for evaporating water collected in reservoir 10, a heat radiating plate 12 coupled to auxiliary condenser 11 for externally radiating heat produced from the auxiliary condenser, and a front cover 13 for enveloping auxiliary condenser 11 and reservoir 10 in order to prevent them from being externally exposed and to shield noise.

In the conventional refrigerator, since auxiliary condenser 11 is separately provided on the bottom of reservoir 10 so that the high temperature gas in auxiliary condenser 11 is mainly air cooled, its cooling efficiency is decreased. Further, since heat radiated from auxiliary condenser 11 is lost in the surrounding air when it is subsequently transmitted from radiating plate 12 placed in contact with auxiliary condenser 11 and on the bottom of reservoir 10, the thermal conductivity is inefficient and the evaporation efficiency of the water decreases.

Furthermore, reservoir 10, radiating plate 12 and auxiliary condenser 11 are separately manufactured, making structure and fabrication complicated, as well as increasing cost and manpower in its fabrication.

SUMMARY OF THE INVENTION

It is an object of the present invention to provide a refrigerator which improves the evaporation efficiency of water produced during defrosting and the cooling efficiency of an auxiliary condenser, and which is simple in the structure.

It is another object of the present invention to provide a refrigerator whose front cover is detachable from its main body so as to collect water overflowing from a fixed reservoir and remove the water.

To accomplish the object, the refrigerator of the present invention comprises a reservoir for collecting water produced during defrosting, an auxiliary condenser for evaporating water collected in the reservoir and cooling the high temperature gas within the condenser using the heat for evaporation, and a front cover for enveloping the auxiliary condenser and reservoir in order to prevent them from being externally exposed, wherein a lot of hollowed projections each having a cavity are provided on the bottom of the bucket and the auxiliary condenser is secured to the top of the projections by supporting pieces in which one end is fixed in contact with the outer surface of the auxiliary condenser and the other end is fixed along one face of the projections, so as to always be in contact with the water.

BRIEF DESCRIPTION OF THE DRAWINGS

The above objects and other advantages of the present invention will become more apparent by describing in detail a preferred embodiment of the present invention with reference to the attached drawings in which.

DETAILED DESCRIPTION OF THE INVENTION

Figure 1:
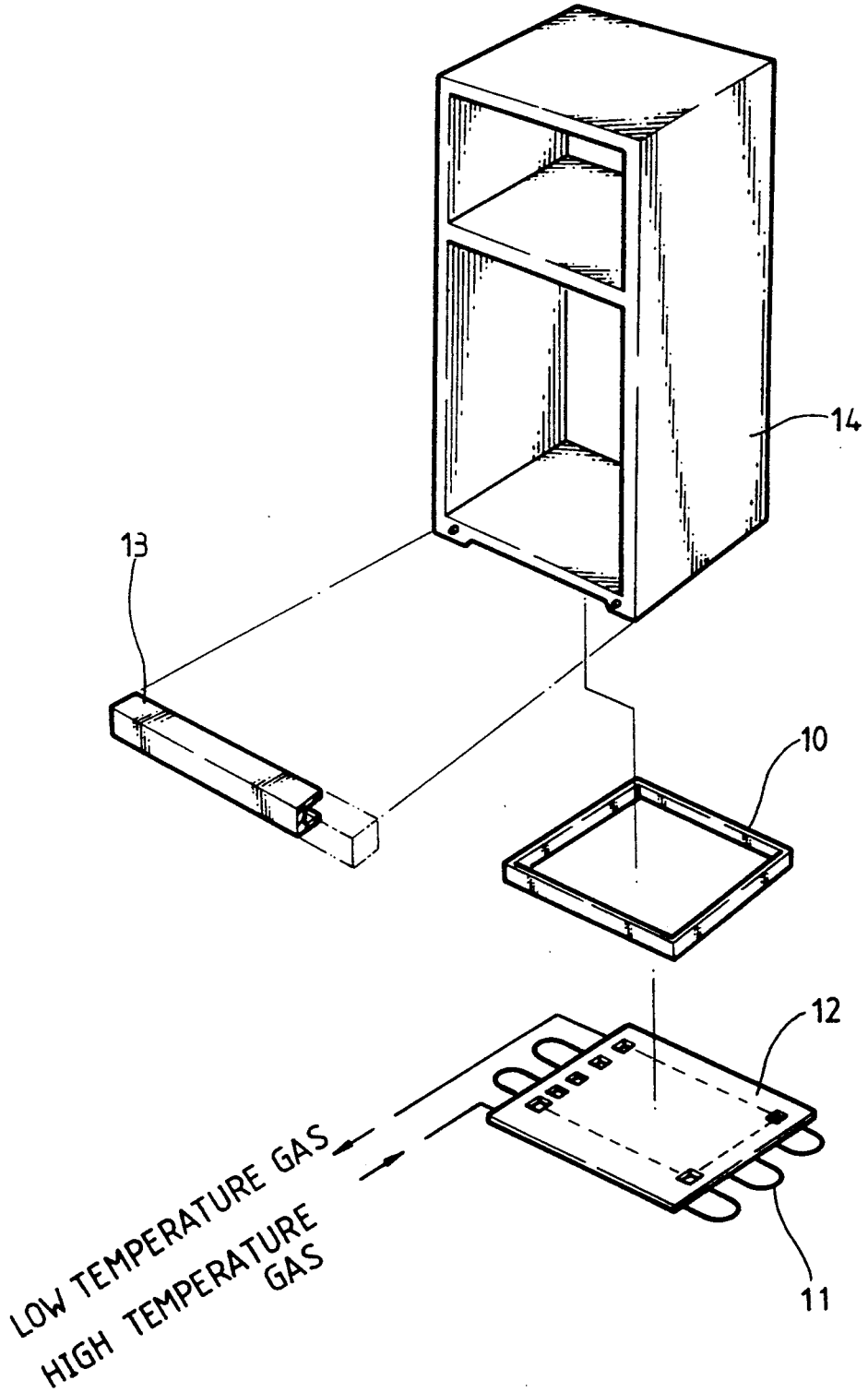
FIG.1(PRIOR ART)
FIG.1 is an exploded perspective view of a conventional refrigerator.
Figure 2:
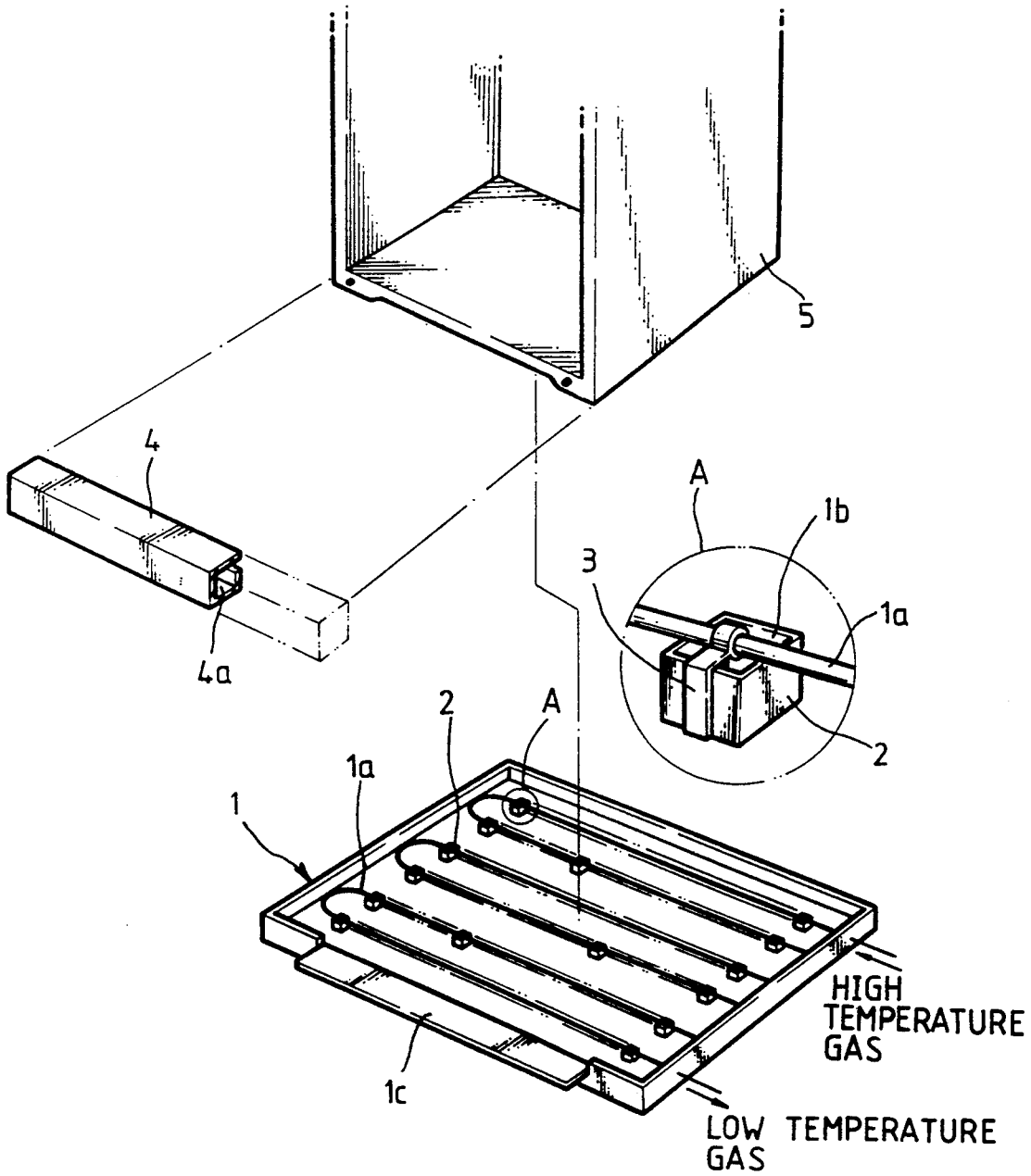
FIG.2 is an exploded perspective view of a refrigerator of the present invention.

Referring to FIG.2, in the refrigerator of the present invention, a great lot of hollowed projections 1*a* having a cavity 1*b* are provided on the bottom of a reservoir 1 for collecting water. An auxiliary condenser 2 is fixed on the top of each projection 1*a* by supporting pieces 3.

Referring to the enlarged portion A in FIG.2, one end of each supporting piece 3 wraps around the outer surfaces of auxiliary condensers 2 for circulating coolant. The other end of supporting pieces 3 is formed along one side of the hollowed projections 1*a*, being in contact therewith so as to always be in contact with the water collected reservoir 1. In addition to the supporting pieces for supporting auxiliary condenser 2 and hollowed projections 1*a* and also directly transferring heat from auxiliary condenser 2 to the water, heat transfer metal pieces (not shown) for transferring heat from auxiliary condenser 2 only to the water may be provided along the auxiliary condenser.

Meanwhile, a water path 1*c* is formed on one side of reservoir 1, being lower than the other sides to provide a path for water overflowing from reservoir 1. A front cover for enveloping reservoir 1 and auxiliary condenser 2 in order to prevent them from being externally exposed and to shield noise, a cistern 4*a* is formed to collect water overflowing through water path 1*c*.

Figure 3:
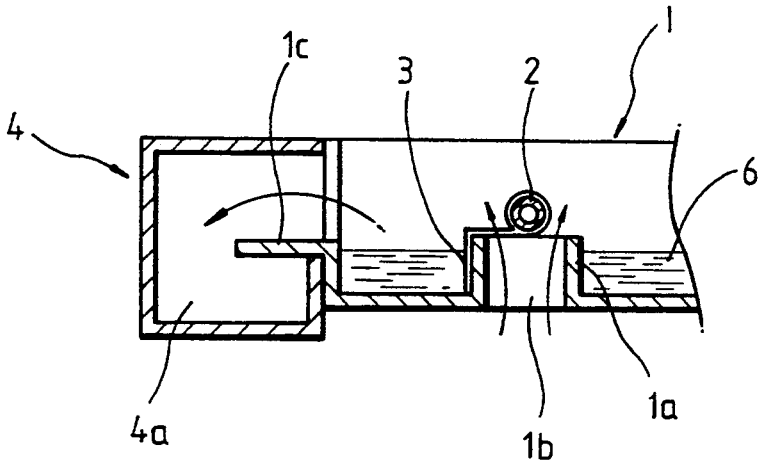
FIG.3 is an extracted sectional view which illustrates a coupling state of the front cover and reservoir in FIG.2.

In FIG.3, water 6 collected in the bottom of reservoir 1 is evaporated by heat which is transferred through supporting pieces 3 and from the high temperature gas in auxiliary condenser 2, and overflows into front cover 4 through water path 1*c* when the amount of the collected water is more than that of the evaporated water. Since front cover 4 is provided detachably from main body 5 of refrigerator in FIG.2, water collected in cistern 4*a* can be removed periodically.

In the refrigerator of the present invention, since heat radiated from the high temperature coolant in auxiliary condenser 2 is cooled by being directly transferred to the water through supporting pieces 3 and simultaneously is also cooled by air fed to the cavities of the hollowed projections 1*a*, the cooling efficiency of auxiliary condenser 2 is increased. Since heat from auxiliary condenser 2 is directly transferred to the water, the evaporation efficiency of the water is increased. Unevaporated water is removed by detaching front cover 4 being detachable from the main body and having cistern 4*a* for collecting water overflowing from reservoir 1.

That means that front cover 4 functions as an auxiliary reservoir.

As described above in detail, the refrigerator of the present invention improves the cooling efficiency of an auxiliary condenser and the evaporation efficiency of water by directly transferring heat radiated from the auxiliary condenser to the water through supporting pieces thereby enhancing the quality of the product, and has a cistern in a front cover, thereby simplifying the structure to reduce production cost and facilitate its use.

While the invention has been particularly shown and described with reference to preferred embodiments thereof, it will be understood by those skilled in the art that various changes in form and details may be made therein without departing from the spirit and scope of the invention as defined by the appended claims.

What is claimed is:

1. A refrigerator comprising:

a reservoir for collecting water;

an auxiliary condenser for evaporating water collected in said reservoir and cooling the high temperature gas within said condenser using the heat for evaporation; and a front cover for enveloping said auxiliary condenser and reservoir in order to prevent them from being externally exposed, wherein a plurality of hollowed projections each having a cavity are provided on the bottom of said reservoir and said auxiliary condenser is secured to the top of said hollowed projections by supporting pieces in which one end is fixed in contact with the outer surface of said auxiliary condenser and the other end is fixed along one face of said hollowed projections, as so to always be in contact with the water.

2. A refrigerator as claimed in claim 1, wherein a water path is formed on one side of said reservoir, being lower than the other sides and a cistern is formed in said front cover to collect water overflowing through said water path.

3. A refrigerator as claimed in claim 2, wherein said front cover is detachable from said refrigerator's main body.

4. A refrigerator as claimed in claim 1 further comprising heat transfer metal pieces which directly transfer heat from said auxiliary condenser to the water without being in contact with said hollowed projections.

5. A refrigerator, comprising:

reservoir means for collecting water;

condenser means for evaporating water collected in said reservoir means, and for cooling fluids within said condenser means by radiating heat from said fluids;

a plurality of hollowed projections each having a cavity, positioned upon a bottom of said reservoir means; and a plurality of supporting pieces securing said condenser means to tops of corresponding ones of said hollowed projections, each of said supporting pieces having a first end in contact with corresponding outer surfaces of said condenser means and having a second end fixed along one face of said corresponding ones of said hollowed projections and positioned to be always in contact with the water held by said reservoir means.

6. The refrigerator of claim 5, further comprising said plurality of hollowed projections comprising an array distributed upon said bottom.

7. The refrigerator of claim 5, further comprising each of said tops of said hollowed projections accommodating passage of air ambient to said reservoir means through said corresponding ones of said hollowed projections.

8. The refrigerator of claim 6, further comprising each of said tops of said hollowed projections accommodating passage of air ambient to said reservoir means through said corresponding ones of said hollowed projections.

9. The refrigerator of claim 5, further comprising:

each of said tops of said hollowed projections accommodating passage of air ambient to said reservoir means through corresponding ones of said hollowed projections; and said plurality of supporting means positioning said outer surfaces of said condenser means within said passage of air.

10. The refrigerator of claim 6, further comprising:

each of said tops of said hollowed projections accommodating passage of air ambient to said reservoir means through corresponding ones of said hollowed projections; and said plurality of supporting means positioning said outer surfaces of said condenser means within said passage of air.

11. The refrigerator of claim 5, further comprising:

said reservoir means having a plurality of sides, with one of said sides being lower than others of said sides and accommodating a flow of water from within said reservoir means; and cover means containing a cistern, for preventing external exposure of said reservoir means, and for receiving said flow of water into said cistern.

12. The refrigerator of claim 6, further comprising:

said reservoir means having a plurality of sides, with one of said sides being lower than others of said sides and accommodating a flow of water from within said reservoir means; and cover means containing a cistern, for preventing external exposure of said reservoir means, and for receiving said flow of water into said cistern.

13. The refrigerator of claim 7, further comprising:

said reservoir means having a plurality of sides, with one of said sides being lower than others of said sides and accommodating a flow of water from within said reservoir means; and cover means containing a cistern, for preventing external exposure of said reservoir means, and for receiving said flow of water into said cistern.

14. The refrigerator of claim 8, further comprising:

said reservoir means having a plurality of sides, with one of said sides being lower than others of said sides and accommodating a flow of water from within said reservoir means; and cover means containing a cistern, for preventing external exposure of said reservoir means, and for receiving said flow of water into said cistern.

15. The refrigerator of claim 9, further comprising:

said reservoir means having a plurality of sides, with one of said sides being lower than others of said sides and accommodating a flow of water from within said reservoir means; and cover means containing a cistern, for preventing external exposure of said reservoir means, and for receiving said flow of water into said cistern.

16. The refrigerator of claim 10, further comprising:

said reservoir means having a plurality of sides, with one of said sides being lower than others of said sides and accommodating a flow of water from within said reservoir means; and cover means containing a cistern, for preventing external exposure of said reservoir means, and for receiving said flow of water into said cistern.

17. The refrigerator of claim 5, further comprising said supporting pieces maintaining said condenser from being in contact with said corresponding ones of said hollowed projections.

18. The refrigerator of claim 6, further comprising said supporting pieces maintaining said condenser from being in contact with said corresponding ones of said hollowed projections.

19. The refrigerator of claim 16, further comprising said supporting pieces maintaining said condenser from being in contact with said corresponding ones of said hollowed projections.

20. A refrigerator, comprising:

reservoir means for collecting water;

condenser means for evaporating water collected in said reservoir means, and for cooling fluids within said condenser means by radiating heat from said fluids;

a plurality of hollowed projections each having a cavity and an open top, positioned upon a bottom of said reservoir means; and a plurality of supporting pieces each having a first end in heat conducting contact with and securing a corresponding outer surface of said condenser means to a corresponding said open top, each of said supporting pieces having a second end fixed along corresponding side faces of said corresponding ones of said hollowed projections and positioned to be always in contact with the water held by said reservoir means.

* * * * *